US005362588A

United States Patent [19]

Yoshihara et al.

[11] Patent Number: 5,362,588

[45] Date of Patent: Nov. 8, 1994

[54] ELECTROPHOTOGRAPHIC PHOTOSENSITIVE MEMBER AND APPARATUS INCLUDING SAME

[75] Inventors: Toshiyuki Yoshihara, Inagi; Nobuyuki Hanami, Matsudo; Hideki Anayama, Yokohama; Junichi Kishi; Hideyuki Ainoya, both of Tokyo, all of Japan

[73] Assignee: Canon Kabushiki Kaisha, Tokyo, Japan

[21] Appl. No.: 920,637

[22] Filed: Jul. 28, 1992

[30] Foreign Application Priority Data

Aug. 1, 1991 [JP] Japan ..... 3-193178

[51] Int. Cl.[5] ..... G03G 5/02; G03G 15/00

[52] U.S. Cl. ..... 430/69; 355/211; 430/127

[58] Field of Search ..... 355/211; 430/69, 127

[56] References Cited

U.S. PATENT DOCUMENTS 4,045,134 8/1977 Suzuki et al. ..... 355/3 R

FOREIGN PATENT DOCUMENTS 0387815 9/1990 European Pat. Off. .

4-136947 5/1992 Japan .

5-72750 3/1993 Japan .

OTHER PUBLICATIONS

Patent Abstracts of Japan, vol. 8, No. 137 p. (282) [1574] Jun. 26, 1984.

*Primary Examiner*—Marion E. McCamish

*Assistant Examiner*—Rosemary Ashton

*Attorney, Agent, or Firm*—Fitzpatrick, Cella, Harper & Scinto

[57] ABSTRACT

An electrophotographic photosensitive member is formed by a cylindrical substrate and a photosensitive layer disposed on the cylindrical substrate. The cylindrical substrate has a circumferential end section adjacent to at least one longitudinal end of the cylindrical substrate, and the circumferential end section has the photosensitive layer thereon removed and has been subjected to cutting. The electrophotographic photosensitive member is characterized by the circumferential end section having a smooth surface on the cylindrical substrate. The photosensitive member co-operates with a peripheral member, such as a spacer or a sealing member, at the end section in performing a stable electrophotographic process.

12 Claims, 3 Drawing Sheets

ELECTROPHOTOGRAPHIC PHOTOSENSITIVE MEMBER AND APPARATUS INCLUDING SAME

FIELD OF THE INVENTION AND RELATED ART

The present invention relates to an electrophotographic photosensitive (or electrophotosensitive) member, particularly to an electrophotographic photosensitive member effective in performing positioning or sealing by utilizing a circumferential end section (hereinafter, sometimes referred to as "end section") of the photosensitive member.

An electrophotographic photosensitive member (hereinbelow, sometimes referred to as "photosensitive member") is generally constituted by disposing a photoconductive material (or photoconductor) film on a conductive cylindrical substrate. The photoconductive material film is formed by (vacuum or) vapor deposition or coating. In recent years, a film of an organic photoconductive material has been formed on a cylindrical substrate by applying a coating liquid comprising such an organic photoconductive material dispersed or dissolved in a binder resin with film-forming properties onto the surface of the cylindrical substrate in many cases.

Incidentally, when a photosensitive member is incorporated into an electrophotographic apparatus, various process members are disposed around the photosensitive member. In the above process members, for example, a spacer (or a positioning member) for providing a prescribed gap between the photosensitive member and a toner-supplying member in a developing step or a sealing member for suppressing leakage (or escape) of a waste toner in a cleaning step is disposed on a circumferential end section of the photosensitive member. These members generally perform their functions by abutting or pressing themselves to the end section of the photosensitive member, whereby a part of a photosensitive layer formed on the surface of a cylindrical substrate is previously removed or abraded in many cases. This is because the photosensitive layer generally has a low degree of hardness compared with the cylindrical substrate or, in many cases, the surface of the end section of the photosensitive layer is not smooth (or even) after the above-mentioned film-forming process. Accordingly, a technique of partly removing a film which once has been formed on the substrate is required.

Heretofore, in order to provide a smooth surface on the end section of the substrate, there have been applied some methods such that a coating film is removed or exfoliated from a photosensitive member before a drying step and such that masking using, e.g., masking tape is employed when vapor deposition is conducted. In the former, however, the resultant photosensitive member encounters a drawback such that the coating film can not be removed with an accurate measurement in a width direction (i.e., with a high width-accuracy) or such that an end part of the remaining coating film has a protuberant or a blister due to sagging caused by a solvent treatment. In the latter, an end part of the resultant film in contact with the masking tape unavoidably has a protuberant or raised form. As a result, such a protuberance interferes with or affects a positioning member or a sealing member disposed on the end section of the photosensitive member to cause an undesirable phenomenon such as unevenness of developed images, leakage of a waste toner, or breakage of the sealing member. Further, when the coating film is removed with a low width-accuracy, a photosensitive member and an apparatus including the photosensitive member are required to have unnecessarily large sizes so as to minimize or suppress a negative influence due to the low width-accuracy.

SUMMARY OF THE INVENTION

An object of the present invention is to provide an electrophotographic photosensitive member with high width accuracy and surface-accuracy at a circumferential end section of a cylindrical substrate on which a photosensitive layer is not formed.

Another object of the present invention is to provide an apparatus unit, an electrophotographic apparatus and a facsimile apparatus each including the electrophotographic photosensitive member.

According to the present invention, there is provided an electrophotographic photosensitive member, comprising: a cylindrical substrate and a photosensitive layer disposed on the cylindrical substrate, wherein the cylindrical substrate has a circumferential end section adjacent to at least one longitudinal end of the cylindrical substrate, and the circumferential end section is uncovered with the photosensitive layer and has been subjected to cutting.

According to the present invention, there is also provided an apparatus unit, comprising:

an electrophotographic photosensitive member, and at least one of a charging means, a developing means and a cleaning means integrally supported with the electrophotographic photosensitive member to form a single unit, which can be connected to or released from an apparatus body as desired;

the electrophotographic photosensitive member, comprising a cylindrical substrate and a photosensitive layer disposed on the cylindrical substrate, wherein the cylindrical substrate has a circumferential end section adjacent to at least one longitudinal end of the cylindrical substrate, and the circumferential end section is uncovered with the photosensitive layer and has been subjected to cutting.

According to the present invention, there is further provided an electrophotographic apparatus, comprising:

a electrophotographic photosensitive member, a means for forming a latent image, a means for developing the latent image, and a means for transferring the developed image onto a transfer-receiving member;

the electrophotographic photosensitive member, comprising a cylindrical substrate and a photosensitive layer disposed on the cylindrical substrate, wherein the cylindrical substrate has a circumferential end section adjacent to at least one longitudinal end of the cylindrical substrate, and the circumferential end section is uncovered with the photosensitive layer and has been subjected to cutting.

According to the present invention, there is still further provided a facsimile apparatus, comprising:

an electrophotographic apparatus and a receiving means for receiving image data from a remote terminal wherein the electrophotographic apparatus comprises an electrophotographic photosensitive member, a means for forming a latent image, a means for developing the latent image, and a means for transferring the developed image onto a transfer-receiving member;

the electrophotographic photosensitive member, comprising a cylindrical substrate and a photosensitive layer disposed on the cylindrical substrate, wherein the cylindrical substrate has a circumferential end section adjacent to at least one longitudinal end of the cylindrical substrate, and the circumferential end section is uncovered with the photosensitive layer and has been subjected to cutting.

These and other objects, features and advantages of the present invention will become more apparent upon a consideration of the following description of the preferred embodiments of the present invention taken in conjunction with the accompanying drawings.

DESCRIPTION OF THE PREFERRED EMBODIMENT

Figure 1A:
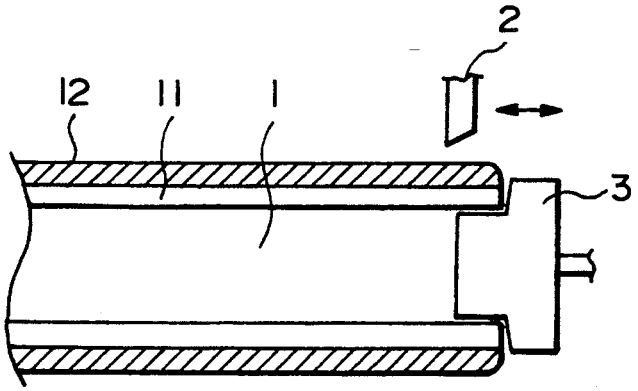
FIGS. 1A and 1B are schematic sectional views showing a cutting process of a circumferential end section of the photosensitive member according to the present invention.

First, a process of cutting a circumferential end section of a photosensitive member in the present invention will be explained.

A cutting member such as a whetstone or a cutting bit (or cutting tool) is abutted on a circumferential surface at an end section adjacent to a longitudinal end of a cylindrical substrate (i.e., at a circumferential end section) of a photosensitive member which is rotated by a driving system. At this time, the cutting member is abutted on a circumferential surface of the photosensitive layer and then continuously abutted on a circumferential surface of the cylindrical substrate in order to improve a smoothness of the surface of the cylindrical substrate abutted on the cutting member. As a result, a stable electrophotographic process is realized by performing the above process.

Herein, a circumferential end section may preferably have a width of 10–30 mm, particularly 10–20 mm, and is, e.g., in the form of a belt. A cutting amount of a cylindrical substrate to be removed is defined as a thickness or depth of the cylindrical substrate which has been cut in a direction perpendicular to the axis of rotation through the circumferential surface (hereinafter, referred to as "cutting depth"). In the present invention, a cutting depth may preferably be at least 5 microns in view of a surface smoothness. Further, the cutting depth may preferably be at most 200 microns. Above 200 microns, a distance or a gap between the cylindrical surface and the surface of a photosensitive layer becomes too large, thus resulting in a decrease in a sealing property when a sealing member is disposed on the above cylindrical substrate. In addition, a thickness Of the cylindrical substrate per se is decreased to reduce its strength.

In the present invention, the surface smoothness of the cylindrical substrate which has been cut may preferably be at most 5 microns, particularly at most 3 microns, in terms of a ten-point mean roughness (Rz) according to Japanese Industrial Standard (JIS) B0601 (reference length=2.5 mm). More specifically, the ten-point mean roughness (Rz) is determined from the difference, obtaining respective mean values by measuring five altitude values of peaks and valleys, respectively, from the highest to the 5th and from deepest to the 5th, on a sampled portion having a reference length of 2.5 mm at the surface of a cylindrical substrate.

A width of the end section of the cylindrical substrate which has been cut (herein, referred to as "cutting width") may be determined in view of sizes of a cylindrical substrate, a positioning member, a sealing member, etc. In general, a cutting width may be at most 30 mm, preferably be at most 20 mm.

Then, a specific embodiment of the present invention will be described.

A cylindrical substrate may be electroconductive and may comprise a metal material such as aluminum, copper or stainless steel. Preferred examples of the metal material may include aluminum and an aluminum alloy. This is because these materials are excellent in cutting processability. More preferred examples of the metal material may include an alloy of aluminum and manganese (Al—Mn alloy, JIS classification No. 3000 series) and an alloy of aluminum, manganese and silicon (Al—Mn—Si alloy, JIS classification No. 6000 series).

A photosensitive layer is formed on the cylindrical substrate. As a photosensitive layer containing an organic photoconductive material, it is possible to use one formed by applying a coating liquid containing a known organic photoconductive material dispersed or dissolved in a solvent together with a binder resin having film-forming properties onto the surface of a cylindrical substrate and further by drying the resultant substrate. The photosensitive layer generally has a laminar structure formed by two or more layers, including a charge generation layer and a charge transport layer, performing different functions (i.e., so-called function separation-type). It is possible to employ a conductive coating layer, an intermediate layer, a barrier layer, etc., each performing an auxiliary function, as desired. These layers may be formed by a known coating method such as dipping or spray coating. When the cylindrical substrate is coated or covered with the above-mentioned layers, a coating film comprising the photosensitive layer and the above additional layers covers up to at least one longitudinal end of the cylindrical substrate. The above coating film formed on the cylindrical substrate may generally have a thickness of about 10 to 100 microns in total.

Figure 1B:
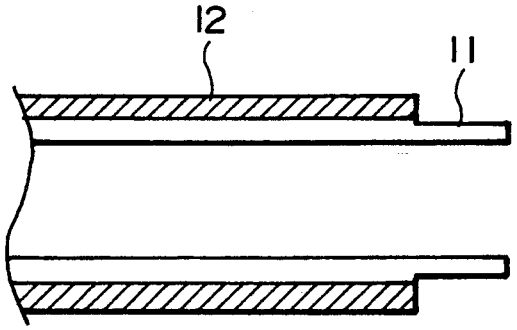

FIGS. 1A and 1B are schematic sectional views showing a cutting process of a cylindrical end of the photosensitive member of the present invention.

Referring to FIG. 1A, a photosensitive member 1 is incorporated into a cutting apparatus. The photosensitive member 1 comprises a cylindrical substrate 11 and a photosensitive layer 12 disposed on the cylindrical substrate 11, and is held by a chucking member 3. The photosensitive member 1 is rotated by a driving system (not shown). Over a circumferential end section of the photosensitive member, a cutting member 2 is disposed. The cutting member 2 is abutted on the end section of the photosensitive layer 12 while the photosensitive member 1 is rotated. A cutting process is performed by moving the cutting member 2 comprising a cutting bit or tool in the direction of an arrow by means of a driving system (not shown). FIG. 1B shows a state of the photosensitive member after the cutting. It is possible to subject both end sections of a photosensitive member to a cutting process or a cutting as mentioned above.

In the present invention, it is possible to use the conventional cutting bit made of a known material and having a known shape. The cutting bit may be selected so as to meet a cylindrical substrate used because a coating film of a photosensitive layer to be removed generally has a low hardness. A cutting angle (i.e., an angle that the cutting face of the cutting bit makes with a working surface (of the end section)) may preferably be at most 90 degrees as shown in FIG. 1A in view of removal or peeling of the coating film. Herein, a total cutting amount of a coating film and cylindrical substrate to be removed is defined as a total thickness or depth of the coating film (i.e., photosensitive layer) and the cylindrical substrate (hereinafter, referred to as "total cutting depth").

Figure 2:
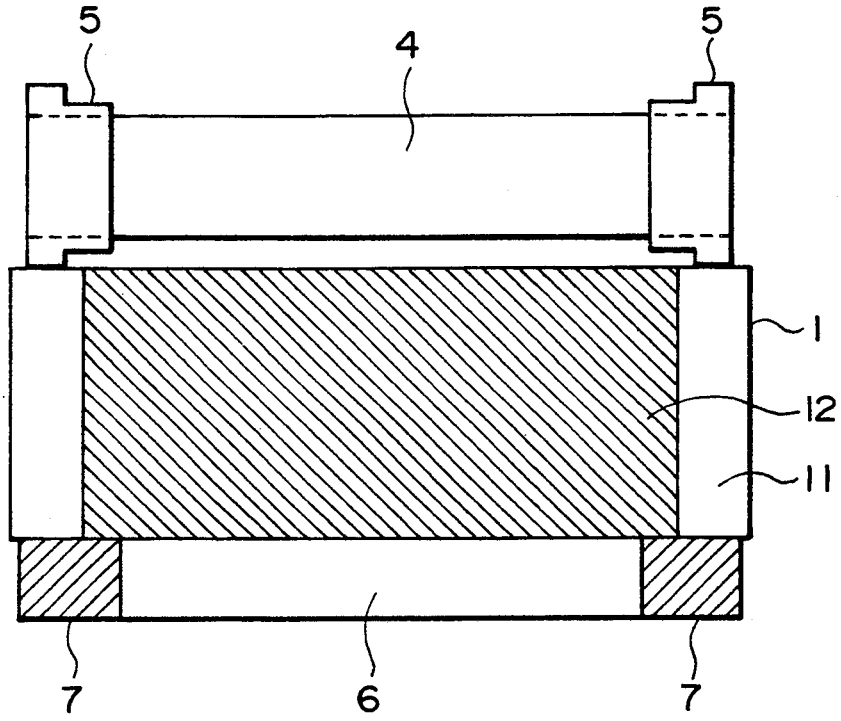
FIG. 2 is a schematic sectional view showing state of the photosensitive member of the present invention incorporated into an electrophotographic apparatus.

FIG. 2 shows an embodiment of a schematic sectional view wherein the above-mentioned photosensitive member is incorporated into an electrophotographic apparatus.

Referring to FIG. 2, a developer (toner)-supplying member 4 and a cleaning blade 6 among process members disposed around a photosensitive member 1 are exemplified. A positioning member 5, for maintaining a constant gap between the photosensitive member 1 and the toner-supplying member 4, is connected or joined to both ends of the toner-supplying member 4. The positioning member 5 is abutted on the end section of a cylindrical substrate 11 on which a photosensitive layer 12 is not formed. On the other hand, an edge of the cleaning blade 6 is abutted on the surface of the photosensitive layer. Further, in order to prevent leakage or escape of a toner from a cleaning vessel or container, a sealing member 7 is disposed on both ends of the cleaning blade 6 and is abutted on the surface of the photosensitive layer and the end section of the cylindrical substrate uncovered with the photosensitive layer under pressure. The positioning member 5 may generally comprise a molded resin, and the sealing member 7 may generally comprise a foamed elastomeric material. It is also possible to dispose a charging member so as to be abutted on the photosensitive member.

Figure 3:
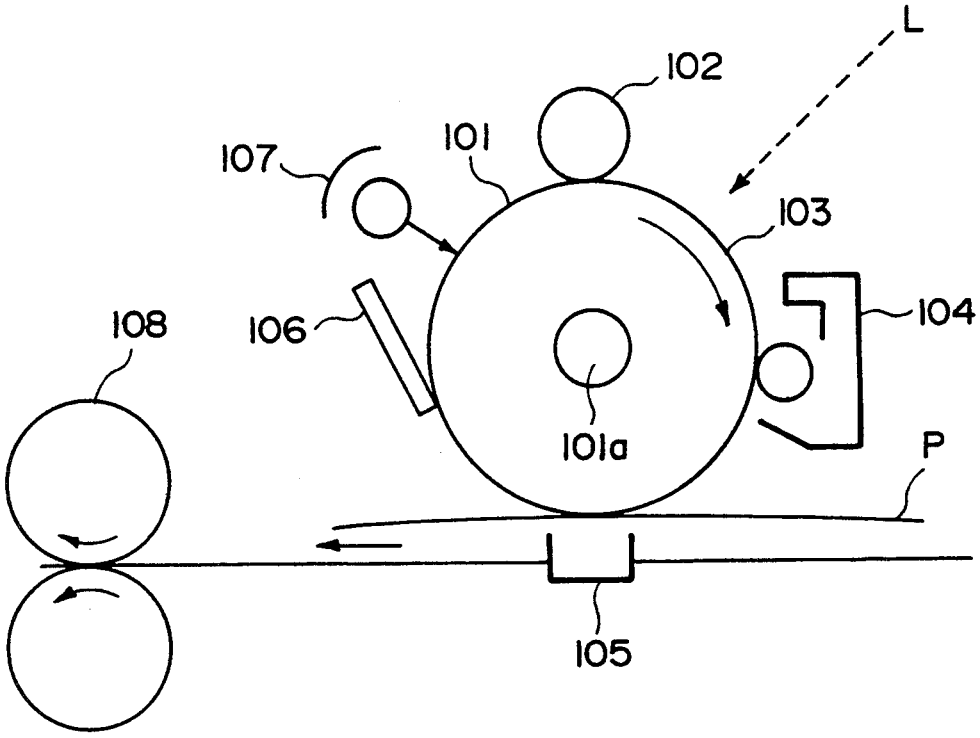
FIG. 3 is a schematic structural view of a transfer-type electrophotographic apparatus using the electrophotosensitive member of the present invention.

FIG. 3 shows an outline of an ordinary transfer-type electrophotographic apparatus including a photosensitive member according to the present invention.

Referring to FIG. 3, the apparatus includes a photosensitive member 101 which rotates about an axis 101*a* at a prescribed peripheral speed in the direction of the arrow. In the course of the rotation, the circumferential surface of the photosensitive member 101 is uniformly charged to a positive or negative prescribed potential by a charging means 102 and then exposed to image light L by an imagewise exposure means (not shown, such as slit exposure means or laser beam scanning exposure means) at an exposure position 103. As a result, an electrostatic latent image corresponding to the exposure light image is sequentially formed on the circumferential surface of the photosensitive member.

The electrostatic latent image is then developed with a toner by a developing means 104, and the resultant toner image is sequentially transferred by a transfer means 105 onto a transfer material or paper P which has been supplied between the photosensitive member 101 and the transfer means 105 in synchronism With the rotation of the photosensitive member 101 by a paper-supplying unit (not shown).

The transfer material P having received the toner image is separated from the photosensitive member surface and introduced to an image fixing means 108 for image fixation to be discharged as a copy product out of the apparatus.

The surface of the photosensitive member 101 after the image transfer is subjected to removal of transfer-residual toner by a cleaning means 106 to be cleaned and used for repetitive image formation.

A corona charging device is widely used in general as the uniform charging means 102 for the photosensitive member 101. A corona transfer means is also widely used in general as the transfer means 105.

In the electrophotographic apparatus, plural members including some of the above-mentioned photosensitive member 101, developing means 104, cleaning means 106, etc., can be integrally combined to form an apparatus unit so that the unit can be readily connected to or released from the apparatus body. For example, the photosensitive member 101 and the cleaning means 106 can be integrated into a single unit so that it can be attached to or released from the apparatus body by a guide means such as a guide rail provided to the apparatus body. In this instance, the apparatus unit can also be integrally accompanied with the charging means 102 and/or the developing means 104.

In a case where the electrophotographic apparatus is used as a copying machine or a printer, the image light L is a reflected light or transmitted light from an original, or an image light formed by coding read data from an original and scanning a laser beam or driving a light-emitting diode array or a liquid crystal shutter array based on the coded data.

Figure 4:
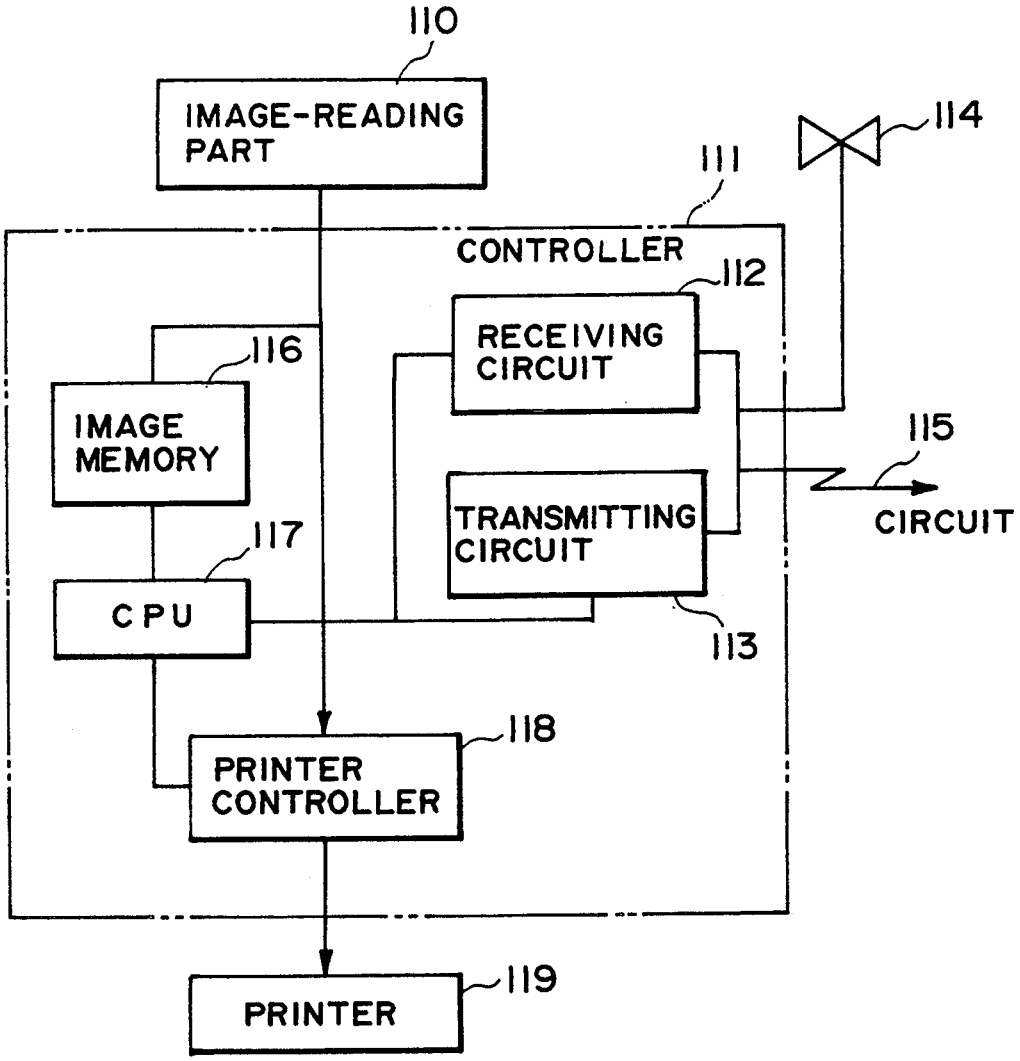
FIG. 4 is a block diagram of a facsimile apparatus using an electrophotographic apparatus including an electrophotosensitive member of the present invention as a printer.

In a case where the image forming apparatus is used as a printer for facsimile, the image light L may be replaced by exposure light image for printing received data. FIG. 4 is a block diagram for illustrating such an embodiment.

Referring to FIG. 4, a controller 111 controls an image reader (or image reading unit) 110 and a printer 119. The entirety of the controller 111 is regulated by a CPU 117. Data read from the image reader 110 is transmitted through a transmitter circuit 113 to a remote terminal such as another facsimile apparatus. On the other hand, data received from a remote terminal is transmitted through a receiver circuit 112 to a printer 119. An image memory 116 stores prescribed image data. A printer controller 118 controls the printer 119. A telephone handset 114 is connected to the receiver circuit 112 and the transmitter circuit 113.

More specifically, an image received from a line (or circuit) 115 (i.e., image data received from a remote terminal connected by the line) is demodulated by means of the receiver circuit 112, decoded by the CPU 117, and sequentially stored in the image memory 116. When image data corresponding to at least one page is stored in the image memory 116, image recording or output is effected with respect to the corresponding page. The CPU 117 reads image data corresponding to one page from the image memory 116, and transmits the decoded data corresponding to one page to the printer controller 118. When the printer controller 118 receives the image data corresponding to one page from the CPU 117, the printer controller 118 controls the printer 119 so that image data recording corresponding to the page is effected. During the recording by the printer 119, the CPU 117 receives another image data corresponding to the next page.

Thus, receiving and recording of an image may be effected in the above-described manner by using an electrophotographic apparatus equipped with a photosensitive member according to the present invention as a printer.

Hereinbelow, the present invention will be explained in detail based on examples.

EXAMPLE 1

An aluminum cylindrical substrate (outer diameter=30 mm, width=260 mm, thickness=0.75 mm) was prepared.

On the cylindrical substrate, the following layers were successively formed by dipping, followed by drying to prepare a photosensitive layer.

(1) Conductive Coating Layer: Thickness of 18 Microns

A coating liquid is principally composed of a dispersion of powders of tin oxide and titanium oxide in a phenolic resin.

(2) Under Coating Layer: Thickness of 1.0 Micron

A coating liquid is principally composed of a modified nylon and a copolymer nylon.

(3) Charge Generation Layer: Thickness of 0.2 Micron

A coating liquid is principally composed of a dispersion of a disazo pigment, showing absorption characteristics in a visible light range, in a acrylic resin.

(4) Charge Transport Layer: Thickness of 25 Microns

A coating liquid is principally composed of a dispersion of a stilbene compound showing a hole-carrying property.

In the above dipping process, the cylindrical substrate was dipped into the respective coating liquid so as to expose an aluminum cylindrical surface (i.e., a part uncovered with the coating liquid) having a width of 5 mm from the upper circular end while the cylindrical substrate was moved vertically on condition that the longitudinal end is parallel to the surface of the coating liquid. Thus, the above coating liquids were successively applied onto the cylindrical surface, from the lower circular (or longitudinal) end to the position at a 5 mm distance from the upper circular (or longitudinal) end, to prepare a photosensitive member.

Then, the above lower circular end of the above-prepared photosensitive member was gripped in a chucking member of a lathe and was subjected to cutting on the following conditions.

Cutting member: diamond bit (Compax 6000, mfd. by Asahi Diamond K.K.)
Cutting speed: 1.5 mm/sec
Total cutting depth: 70 microns
Cutting angle: 45 degrees
Working rotational speed: 2000 rpm
Cutting width: 5 mm Thus, 10 photosensitive members in total were prepared. When each of a butting width of the above photosensitive members was measured, a variation in the cutting widths was within 0.5 mm. A ten-point mean roughness (Rz) of the end section of the cylindrical substrate was 2.5 microns.

Each of the 10 photosensitive members was incorporated into an electrophotographic apparatus including an apparatus unit as shown in FIG. 2 and was subjected to an image-forming test for evaluating a formed image at an initial stage. In the above apparatus unit, a gap between a toner supply member 4 and the photosensitive layer 12 was 250 microns, a gap between an inner cap part of a positioning member 5 and the photosensitive layer 12 was 70 microns (i.e., a thickness of the cap part was 180 microns), and a width of the positioning member 5 abutted on the end section of the cylindrical substrate was 3 mm. The positioning member was made of polyacetal, and a sealing member 7 was made of urethane foam or formed polyurethane and was abutted on the circumferential surface of the photosensitive member. The sealing member 7 had a width of 7 mm and was disposed inside at 1 mm distance from the longitudinal end of the photosensitive member.

One of the above 10 photosensitive members was subjected to an image-forming test (or a durability test) of 10,000 sheets.

In the above two image-forming test, good images were obtained at an initial stage and after 10,000 sheets of copying, and various process members were normally and properly operated.

COMPARATIVE EXAMPLE 1

10 photosensitive members were prepared in the same manner as in Example 1 except that each coating liquid was scraped off or removed in a width of 5 mm by means of a rubber blade before drying. The above scraping was conducted while a solvent used for each coating liquid was supplied to the rubber blade in order to enable easy removal.

When each of a cutting width of the above photosensitive members was measured, a variation in the cutting widths was ±2 mm (i.e., within 4 mm), thus resulting in a low degree of cutting width accuracy.

An image-forming test of the 10 photosensitive members and a durability test of one of the above photosensitive members were conducted in the same manner as in Example 1.

As a result, the following disadvantages with respect to the resultant images or the sealing member were caused.

(1) Sagging or running of the resultant coating due to the solvent during the scraping was caused to occur, thus resulting in a residue of the coating at a part abutted on the positioning member. As a result, a gap between the toner-supplying member and the photosensitive member was held at a constant value to provide images with a large unevenness of developed images.

(2) A protuberance or blister was observed at a remaining end part of the photosensitive layer, and such a protuberance interfered with a normal operation of the positioning member, thus resulting in a large unevenness of developed images.

(3) Such a protuberance of the photosensitive layer caused a gradual leakage of a toner during the durability test because the sealing member was not caused to be sufficiently abutted on the photosensitive member, thus resulting in staining (or pollution) of an apparatus interior due to the leakage of the toner or breakage of the sealing member.

EXAMPLE 2

A photosensitive layer was formed on a cylindrical substrate in the same manner as in Example 1 to prepare a photosensitive member.

Then, the photosensitive member was subjected to cutting in the same manner as in Example 1 except that the following cutting conditions were applied.

Cutting member: diamond bit (Compax 6000)
Cutting speed: 1.5 mm/sec
Total cutting depth: 100 microns
Cutting angle: 60 degrees
Working rotational speed: 2000 rpm
Cutting width: 8 mm The thus-prepared photosensitive member was incorporated into an electrophotographic apparatus similar to one used in Example 1 and subjected to an image-forming test and a durability test in the same manner as in Example 1.

As a result, a sufficiently high image quality was obtained at an initial stage and after the durability test.

A ten-point mean roughness (Rz) of the end section of the cylindrical substrate was 3.5 microns.

EXAMPLE 3

A photosensitive layer was formed on a cylindrical substrate in the same manner as in Example 1 to prepare a photosensitive member.

Then, the photosensitive member was subjected to cutting in the same manner as in Example 1 except that the following cutting conditions were applied.

Cutting member: silicon carbide whetstone
Cutting speed: 0.5 mm/sec
Total cutting depth: 100 microns
Cutting angle: 45 degrees
Working rotational speed: 1000 rpm
Cutting width: 5 mm The thus-prepared photosensitive member was incorporated into an electrophotographic apparatus similar to one used in Example 1 and subjected to an image-forming test and a durability test in the same manner as in Example 1.

As a result, a sufficiently high image quality was obtained at an initial stage and after the durability test.

EXAMPLE 4

An aluminum cylindrical substrate (outer diameter=80 mm, width=360 mm, thickness=1.1 mm) was prepared.

On the cylindrical substrate, four layers similar to those used in Example 1 were successively formed by spray coating, followed by drying to prepare a photosensitive layer. The entire circumferential surface of a resultant photosensitive member was coated or covered with the photosensitive layer.

Then, both end sections of the photosensitive member were subjected to cutting in the same manner as in Example 1 except that the cutting width was changed to 11 mm.

Thus, 10 photosensitive members in total were prepared. When each of a butting width of the above photosensitive members was measured, a variation in the cutting widths was within 0.5 mm. A ten-point mean roughness (Rz) of the end section of the cylindrical substrate was 2 microns.

Each of the 10 photosensitive members was incorporated into an electrophotographic apparatus including an apparatus unit as shown in FIG. 2 and was subjected to an image-forming test for evaluating a formed image at an initial stage. In the above apparatus unit, a gap between a toner supply member 4 and the photosensitive layer 12 was 300 microns, a gap between an inner cap part of a positioning member 5 and the photosensitive layer 12 was 100 microns (i.e., a thickness of the cap part was 200 microns), and a width of the positioning member 5 abutted on the end section of the cylindrical substrate was 4 mm. The positioning member was made of polyacetal, and a sealing member 7 was made of urethane foam or formed polyurethane and was abutted on the circumferential surface of the photosensitive member. The sealing member 7 had a width of 15 mm and was disposed inside at 1 mm distance from the longitudinal end of the photosensitive member.

One of the above 10 photosensitive members was subjected to an image-forming test (or a durability test) of 50,000 sheets.

In the above two image-forming test, good images were obtained at an initial stage and after 50,000 sheets of copying, and various process members were normally and properly operated.

COMPARATIVE EXAMPLE 2

A photosensitive member was prepared in the same manner as in Example 4 except that both end sections of the cylindrical substrate were previously subjected to masking with a 11 mm width-masking tape. The masking tape was removed from the cylindrical substrate after the photosensitive layer was formed.

When the thus-prepared photosensitive member was subjected to an image-forming test, a considerable degree of leakage or escape of a toner through the sealing member was generated because end parts of the photosensitive layer was protuberated or blistered. As a result, staining of an apparatus interior and accompanying staining of a printed sheet were caused to occur.

What is claimed is:

1. An electrophotographic photosensitive member, comprising:

a cylindrical substrate; and a photosensitive layer disposed on the cylindrical substrate, wherein the cylindrical substrate has a circumferential end section adjacent to at least one longitudinal end of the cylindrical substrate, and the circumferential end section has been subjected to cutting which removes the photosensitive layer thereon and smooths the circumferential end section of the cylindrical substrate.

2. A photosensitive member according to claim 1, wherein the circumferential end section which has been cut is in a depth of at least 5 microns.

3. A photosensitive member according to claim 1 or 2, wherein the photosensitive layer is formed as a coating comprising an organic photoconductor and a binder resin.

4. An apparatus unit, comprising:

an electrophotographic photosensitive member; and at least one of a charging means, a developing means and a cleaning means integrally supported with the electrophotographic photosensitive member to form a single unit, which can be connected to or released from an apparatus body as desired;

wherein the electrophotographic photosensitive member comprises a cylindrical substrate and a photosensitive layer disposed on the cylindrical substrate, the cylindrical substrate has a circumferential end section adjacent to at least one longitudinal end of the cylindrical substrate, and the circumferential end section has been subjected to cutting which removes the photosensitive layer thereon and smooths the circumferential end section of the cylindrical substrate.

5. An apparatus unit according to claim 4, wherein the circumferential end section which has been cut is in a depth of at least 5 microns.

6. An apparatus unit according to claim 4 or 5, wherein the photosensitive layer is formed as a coating comprising an organic photoconductor and a binder resin.

7. An electrophotographic apparatus, comprising:

an electrophotographic photosensitive member;

means for forming a latent image;

means for developing the latent image; and means for transferring the developed image onto a transfer-receiving member;

wherein the electrophotographic photosensitive member comprises a cylindrical substrate and a photosensitive layer disposed on the cylindrical substrate, the cylindrical substrate has a circumferential end section adjacent to at least one longitudinal end of the cylindrical substrate, and the circumferential end section has been subjected to cutting which removes the photosensitive layer thereon and smooths the circumferential end section of the cylindrical substrate.

8. An electrophotographic apparatus according to claim 7, wherein the circumferential end section which has been cut is in a depth of at least 5 microns.

9. An electrophotographic apparatus according to claim 7 or 8, wherein the photosensitive layer is formed as a coating comprising an organic photoconductor and a binder resin.

10. A facsimile apparatus, comprising:

an electrophotographic apparatus; and receiving means for receiving image data from a remote terminal, wherein the electrophotographic apparatus comprises an electrophotographic photosensitive member, means for forming a latent image, means for developing the latent image, and means for transferring the developed image onto a transfer-receiving member, the electrophotographic photosensitive member comprises a cylindrical substrate and a photosensitive layer disposed on the cylindrical substrate, the cylindrical substrate has a circumferential end section adjacent to at least one longitudinal end of the cylindrical substrate, and the circumferential end section has been subjected to cutting which removes the photosensitive layer thereon and smooths the circumferential end section of the cylindrical substrate.

11. A facsimile apparatus according to claim 10, wherein the circumferential end section which has been cut is in a depth of at least 5 microns.

12. A facsimile apparatus according to claim 10 or 11, wherein the photosensitive layer is formed as a coating comprising an organic photoconductor and a binder resin.

* * * * *